United States Patent [19]

Schmidt

[11] 4,012,753

[45] Mar. 15, 1977

[54] FILM PROCESSOR

[75] Inventor: Gunter Schmidt, Malibu, Calif.

[73] Assignee: Cubic Productron, Inc., Chula Vista, Calif.

[22] Filed: May 2, 1975

[21] Appl. No.: 574,002

[52] U.S. Cl. ..... 354/316; 137/577; 222/319; 354/321; 354/324; 354/346

[51] Int. Cl.[2] ..... G03D 17/00; G03D 3/02

[58] Field of Search ..... 354/297, 310, 312, 315, 354/316, 319, 320, 321, 322, 324, 339, 340, 344, 345, 346, 347; 134/64 P, 122 P; 222/204, 319, 416; 137/577

[56] References Cited

UNITED STATES PATENTS

| | | | |
|---|---|---|---|
| 623,837 | 4/1899 | Schwarz | 134/64 P |
| 1,244,585 | 10/1917 | Case | 222/319 |
| 1,525,363 | 2/1925 | Boyce | 354/297 X |
| 1,687,581 | 10/1928 | Murphy | 354/340 X |
| 1,890,490 | 12/1932 | Barkelew | 134/64 P |
| 3,033,351 | 5/1962 | Dutch | 354/322 X |
| 3,087,406 | 4/1963 | Dutch | 354/316 |
| 3,345,929 | 10/1967 | Oksakovsky et al. | 354/299 |
| 3,388,653 | 6/1968 | Mayfield | 354/310 X |
| 3,472,144 | 10/1969 | Fisher | 134/64 P |
| 3,517,600 | 6/1970 | Woollacott | 354/324 X |
| 3,575,100 | 4/1971 | Krause | 134/64 P |
| 3,810,568 | 5/1974 | Kwiaikowski et al. | 354/310 X |
| 3,846,818 | 11/1974 | Merz | 354/324 |
| 3,852,793 | 12/1974 | McClintock | 354/324 |

FOREIGN PATENTS OR APPLICATIONS

| | | | |
|---|---|---|---|
| 717,886 | 2/1942 | Germany | 354/339 |
| 301,035 | 11/1954 | Switzerland | 222/319 |
| 1,045,450 | 10/1966 | United Kingdom | 354/324 |

*Primary Examiner*—Fred L. Braun
*Attorney, Agent, or Firm*—Lindenberg, Freilich, Wasserman, Rosen & Fernandez

[57] ABSTRACT

A reliable machine for developing film, which minimizes the possibility of damage to the film surface and which provides close control of processing conditions. A film strip is pulled by a detachable member attached at the front end of the strip, and is guided along the machine by rollers spaced along the film path, with each roller having a film-supporting surface at each end and a wide cutaway portion between the film-supporting surfaces so that each roller touches only edge portions of the film. Chemicals in the tank are replenished by a system which includes a plunger that moves down into the tank to cause some of the chemicals to overflow into a drain and which then moves up out of the tank to lower the fluid level therein, and a bottle with an open lower end which supplies chemicals to restore the fluid to its original level.

9 Claims, 13 Drawing Figures

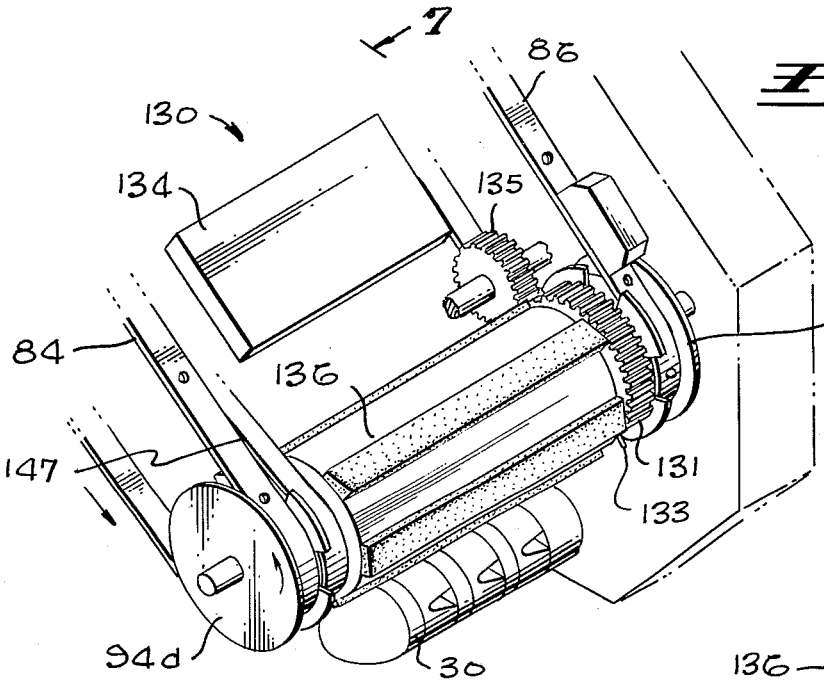
Fig. 6
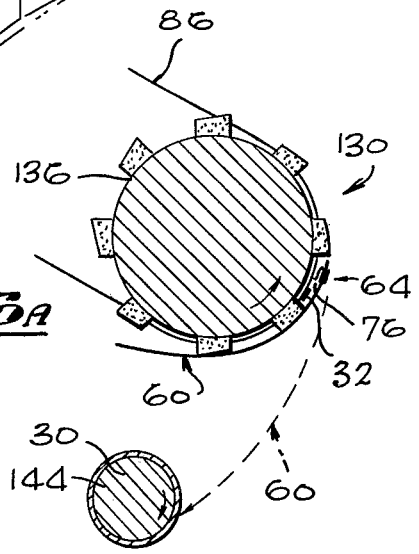
Fig. 6A
Fig. 7
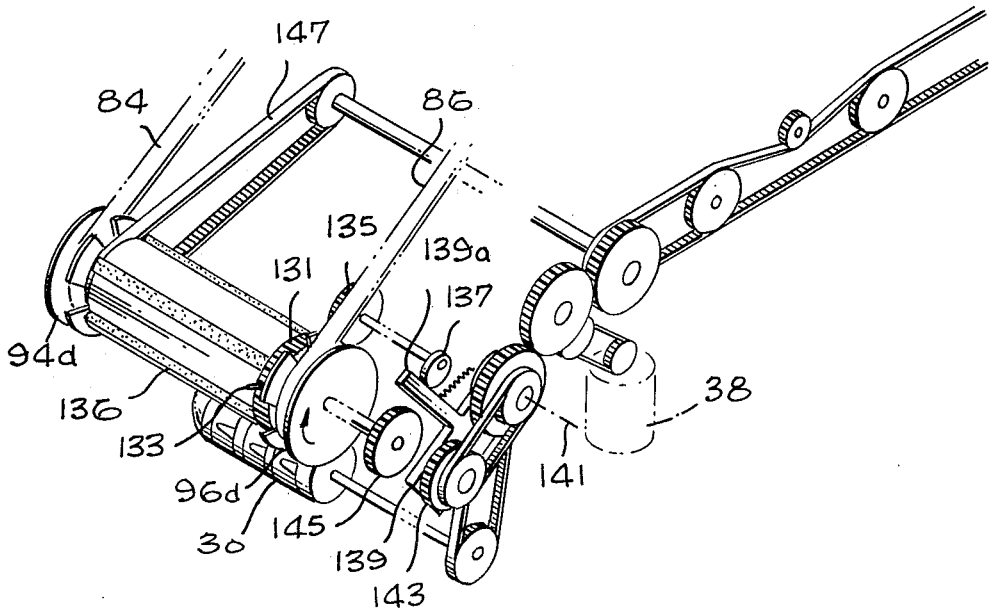

FILM PROCESSOR

BACKGROUND OF THE INVENTION

This invention relates to apparatus for processing film.

One diagnostic method which is increasingly employed in hospitals, utilizes a wide film strip to record a sequence of x-ray images during a medical procedure. Typically, 105 millimeter film is utilized which may not have sprocket holes along the edges, and the images extend to nearly the edges of the film. The exposed film is usually processed in a leaderless roll machine that is designed primarily for sheet film. Such processing can harm the film in that the rollers which must firmly grasp the film to move it through the machine, often produce small areas of damage to the film emulsion, which is especially detrimental where the images are small. The emulsion is highly susceptable to scratching when it is being developed, but becomes resistant to damage after development and drying. The typical processing machine is usually operated at less than optimum conditions, with the immersion time, chemical activity levels, and temperatures often being far from optimum. Such operation is largely due to the fact that personnel responsible for maintaining the processing machines in hospitals often cannot maintain the machines at optimum conditions. A processing machine which could move a film strip in an accurately controlled manner through tanks of processing chemicals with minimal damage to the film emulsion, and which assured close to optimum operating conditions with minimal maintenance, would permit the production of film strips with very clear images in a hospital environment.

SUMMARY OF THE INVENTION

In accordance with one embodiment of the present invention, a film processor is provided which includes a tank assembly that maintains accurate control of processing chemicals in the tanks, and a film transport received in the tank assembly for reliably moving film through the chemical tanks. The tank assembly includes a chemical replenishing system with a plunger that is moved down into each tank to cause some of the chemicals to overflow into a drain, and which then moves up out of the tank to lower the fluid level therein. A bottle of replenishing chemicals is positioned with its lower end even with the desired level of fluid in the tank, so that after the plunger has moved up, fluid moves out of the bottle into the tank until the original level of chemicals is restored.

A transport for moving a film strip through the tanks of chemicals, includes a transport bar that engages a clip attached to the front end of a film strip, to pull the film strip through the tanks of chemicals. The clip is securely fastened to the film strip by punching a pair of holes at the front end of the film strip and inserting the clip therein. The clip has a rearwardly facing opening which receives the transport bar. At the end of film movement, the transport bar is stopped while the film clip is moved forward. As a result, the film clip moves out of engagement with the bar and can fall onto a windup roll. The transport bar is fixed to a pair of belts that move it positively through the film path. A series of guide rollers positioned along the flim path, have cylindrical end portions that support edges of the film and cutaway portions to prevent contact with the emulsion of the film, to thereby minimize the possibility of scratching the film surface.

The novel features of the invention are set forth with particularity in the appended claims. The invention will be best understood from the following description when read in conjunction with the accompanying drawings.

BRIEF DESCRIPTION OF THE DRAWINGS

FIG. 6 is a left rear perspective view of a portion of the transport of FIG. 2, showing the termination portion thereof;

FIG. 6A is a left side elevation view of part of the termination portion of FIG. 6;

FIG. 7 is a right rear perspective view of the termination portion of FIG. 6;

DESCRIPTION OF THE PREFERRED EMBODIMENTS

Figure 1:
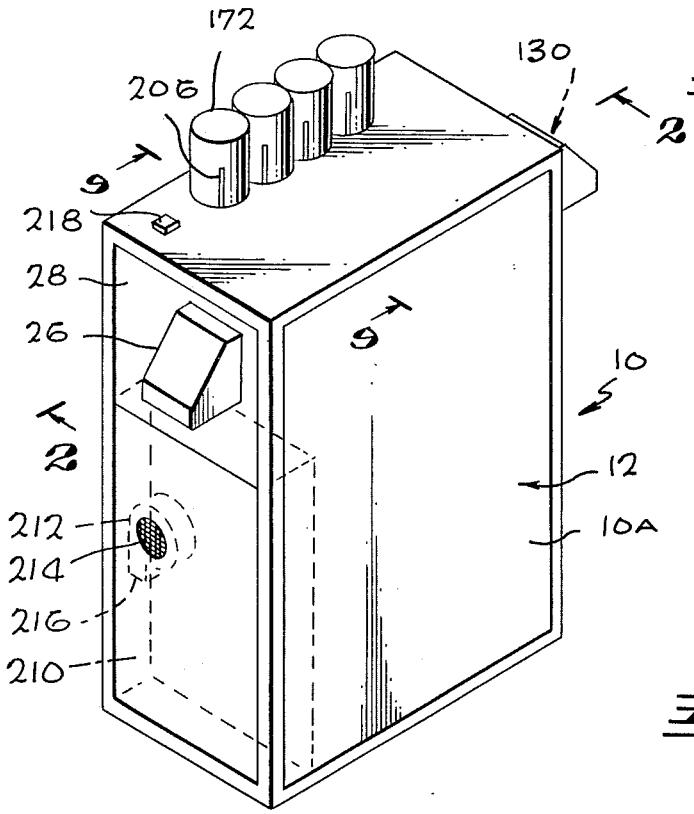
FIG. 1 is a perspective view of a film processor constructed in accordance with the invention.
Figure 4:
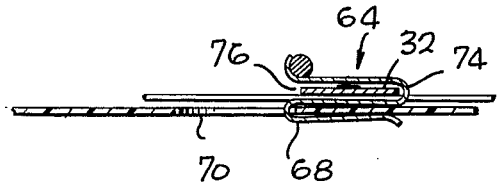
FIG. 4 is a view taken on the line 4—4 of FIG. 3, but with the transport bar received in the film clip thereof.
Figure 2:
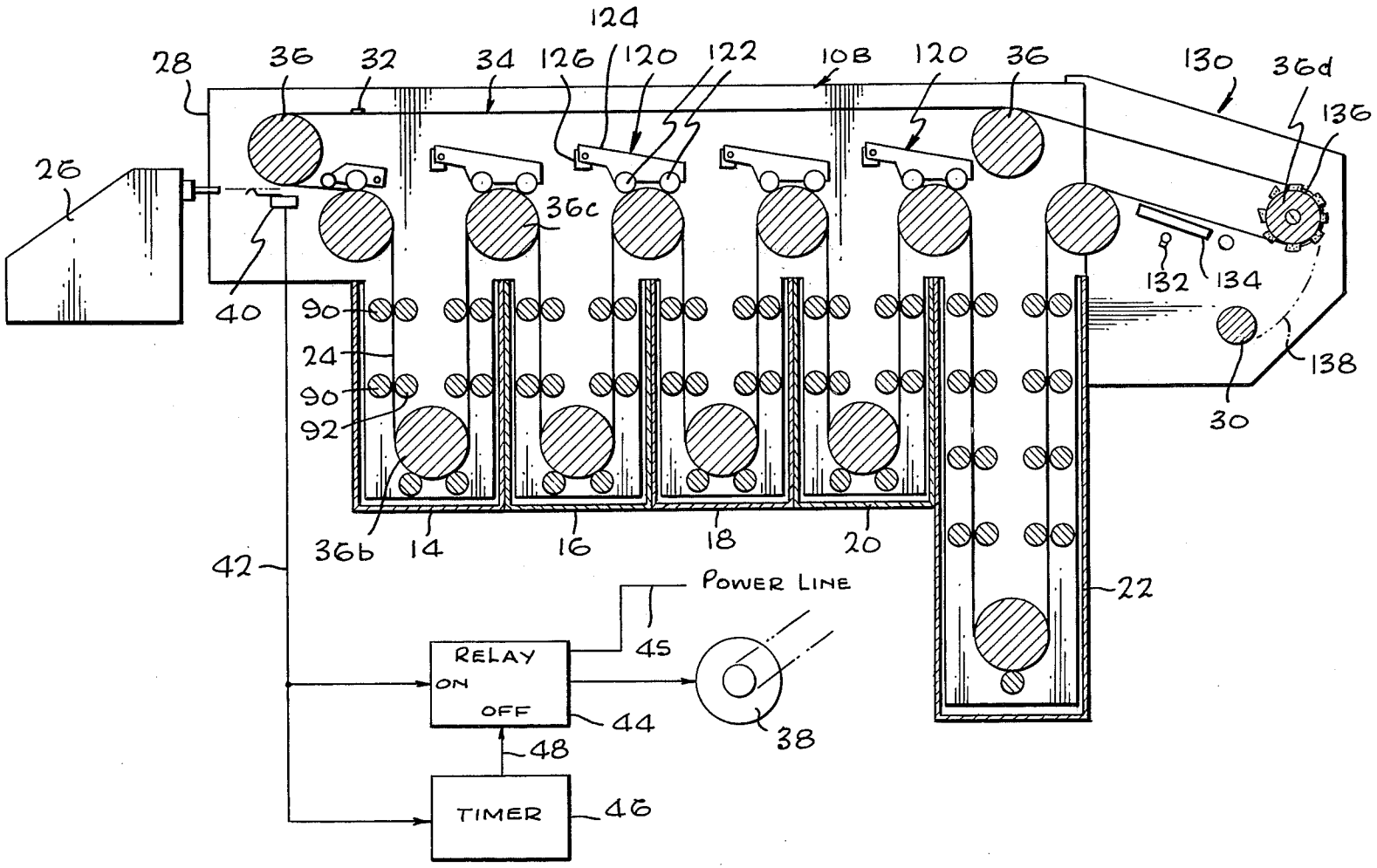
FIG. 2 is a simplified partial sectional view of the processor of FIG. 1, taken on the line 2—2 of FIG. 1 and showing the transport thereof.

FIGS. 1 and 2 illustrate a film processor 10 which includes a frame 12 that supports several tanks 14–20 which hold processing chemicals, the frame also supporting a dryer chamber 22. The machine has a film path 24 along which a strip of film can move, to bring the film down into each tank and up out of the tank and into the next one. The processor is designed so that a portion 10A of the processor forms a tank-holding system, while another portion 10B forms a transport that can be mounted in the tank-holding system, the tank-holding system 10A also being capable of holding other transports such as those for small sheets of film instead of strips. The film processor 10 is designed to receive a cartridge 26 containing exposed film to be developed, the cartridge being mounted at an input end 28 of the frame. The film can traverse the film path 24 until it is received on a wind-up roller 30 at an output end of the frame. The film strip is moved along the film path by a transport member or bar 32 which is fixed to two belts 34 which extend along the film path. The film strip moves around a set of rollers such as 36, while the belts 34 extend about sprocket wheels that are mounted coaxial with the rollers 36. One pair of sprocket wheels which lie coaxial with a brush roll 136, to be described below, is driven by a motor 38 to move the belts 34 and the transport bar 32 thereon along the film path.

When the leading end of a film strip, extending from the cartridge 26, is inserted into the processor, the film strip depresses a film sensor 40 which delivers a signal over a line 42 to a latching relay 44. The relay 44 then connects a power line 45 to the motor 38 to turn one pair of sprocket wheels and move the belts 34 along the film path. The transport bar 32 will engage a clip attached to the leading end of the film strip, as will be described below, and the bar will then move the strip along the film path towards the wind-up roller 30. The sensor 40 is also coupled to a timer 46, and when the trailing end of a film strip passes by the sensor, the sensor ceases to deliver a signal over line 42 and thereby begins a timing cycle of the timer 46. After a predetermined period sufficient for the trailing end of the film strip to pass completely through the processor, the timer delivers a signal to an off input 48 of the relay 44, to turn off the relay so that the motor 38 is no longer energized and the machine stops.

Figure 3:
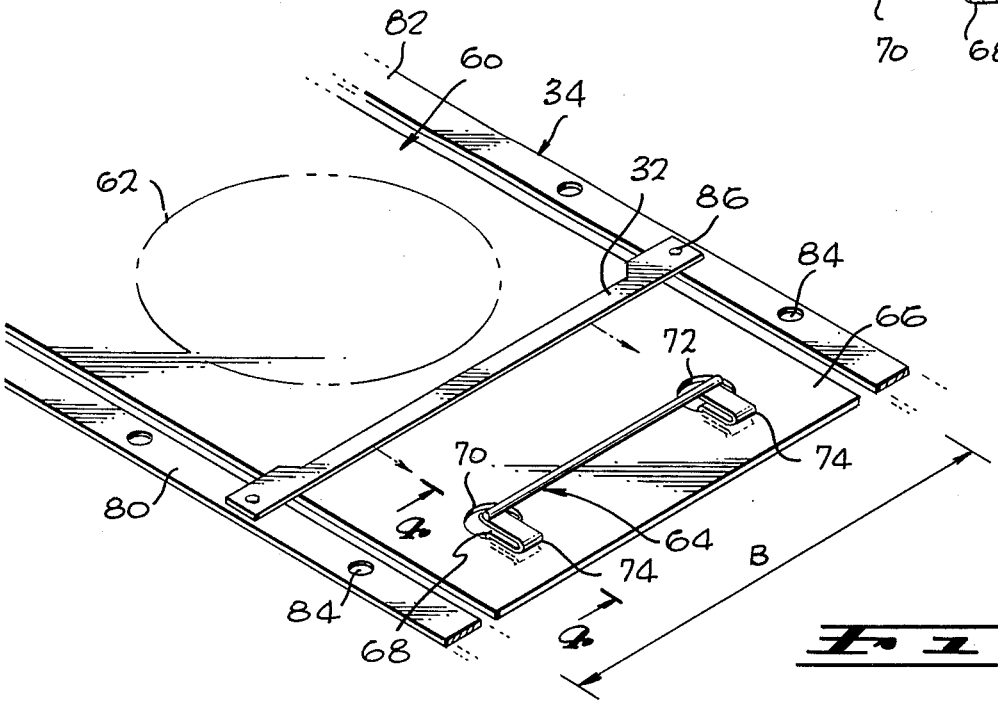
FIG. 3 is a partial perspective view of the processor of FIG. 1, showing the manner in which a transport bar of the processor engages a film clip at the front end of a film strip that is to be processed.

The particular processing machine 10, and especially the transport 10B thereof, is especially useful for processing 105 millimeter film that is often used in making a series of x-ray exposures in a short period of time, as in recording the path of a radiopaque dye injected into an artery of the human body. Such a diagnostic film strip or film, shown at 60 in FIG. 3, typically contains images such as 62 which extend across nearly the entire width of the film, and the film sometimes contains no sprocket holes or the like along either edge. In order to permit the transport bar 32 to move the film through the processing machine, a film clip 64 is provided which is securely attached to the leading end portion 66 of the film strip. The film clip 64 includes a pair of film-holding parts 68 which extend through holes 70, 72 in the film, and a pair of bar-receiving parts 74 which are designed to attach to the transport bar 32. Each bar-receiving part 74 has a rearward opening 76 through which the transport bar 32 can pass to be captured in the bar-receiving parts 74 of the clip.

In order to prepare a film strip for processing, a technician punches the pair of laterally-spaced holes, 70, 72, in the leading end portion 66 of the film, as with a simple paper-type punch with punch members spaced apart by the required distance. He then slips the film-holding parts 68 through the holes and slides them up against the forward portion of the walls of the holes to hold the film clip firmly to the film strip. The technician then inserts the leading edge portion 66 of the film with the clip thereon into the processor along an entrance path therein, so that the clip lies at a pickup location in the path of the transport bar 32 and also trips the sensor 40. The motor 38 is then energized to begin movement of the transport bar 32 along the film path. As the transport bar passes by the film clip, it enters the rearward opening 76 to firmly engage the film clip and drag the film strip out of the cartridge, into the processor, and along the film path 24.

Figure 5:
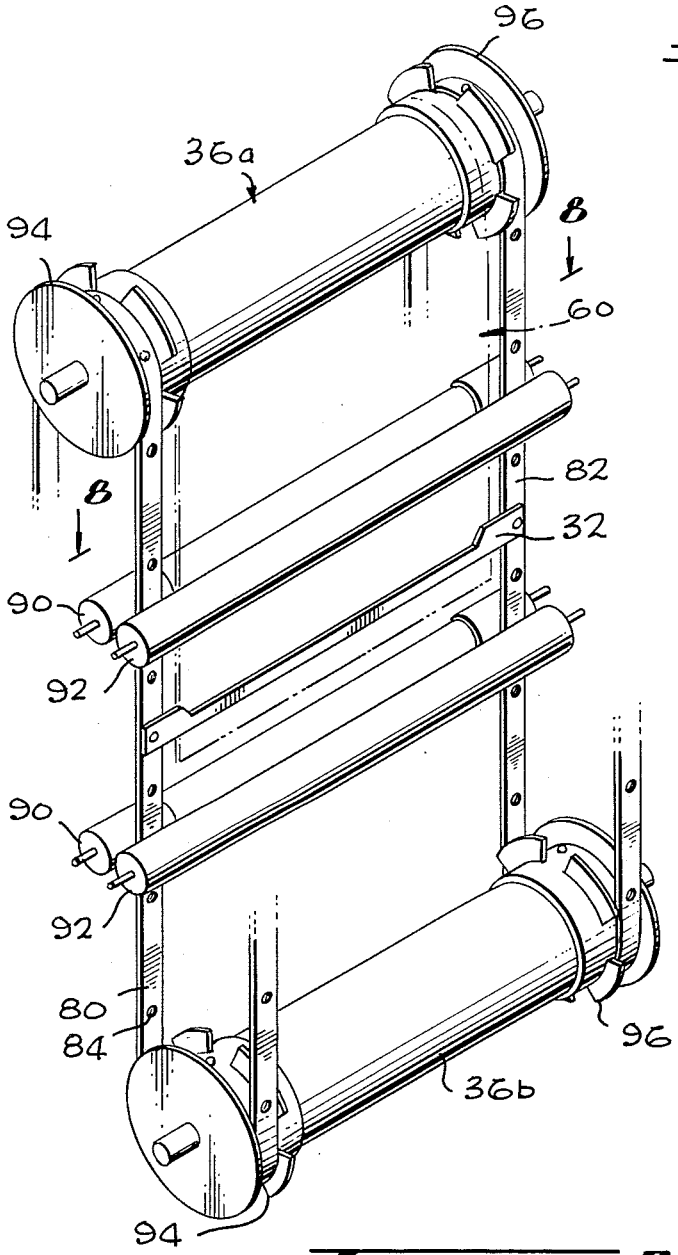
FIG. 5 is a partial perspective view of the transport of FIG. 2, showing how the film strip is guided along a tank thereof.
Figure 5A:
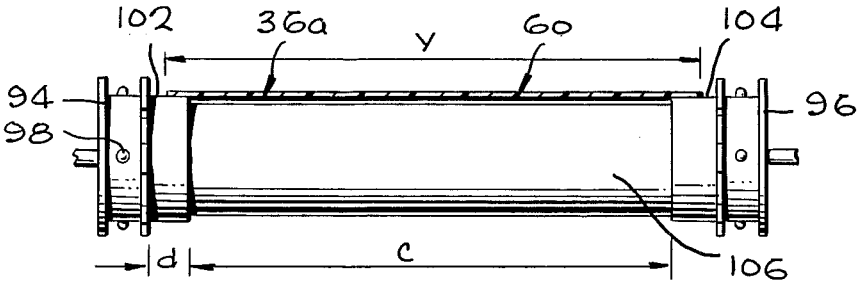
FIG. 5A is a front elevation view of one of the rollers of FIG. 5.

The belt apparatus 34 which moves the transport bar 32, includes a pair of narrow belts 80, 82 with sprocket holes 84 therein, the belts being attached by rivets 86 to the transport bar. The belts 80, 82 are laterally spaced by a distance B which is greater than the width of the widest film strip 60 designed to be processed in the machine. The film moves along a series of major rollers such as **36*a*, 36*b* shown in FIG. 5 and along minor or guide rollers 90, 92. A pair of sprocket wheels 94, 96 (FIG. 5A) is rotatably mounted on each side of each major roller to engage corresponding belts 80, 82. Each sprocket wheel has sprockets 98 that are received in the holes 84 of the belts to prevent slippage of the belts and therefore assure that the transport bar 32 will extend perpendicular to the film path. The rollers such as 36*a* which lie between the sprocket wheels 94, 96 are designed to support and guide the film strip in its movement through the processor. The guide rolls 90, 92** guide both the belts and film strip along the film path.

Figure 8:
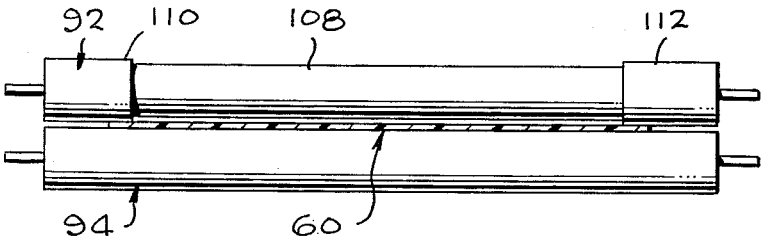
FIG. 8 is a view taken on the line 8—8 of FIG. 5.
Figure 10:
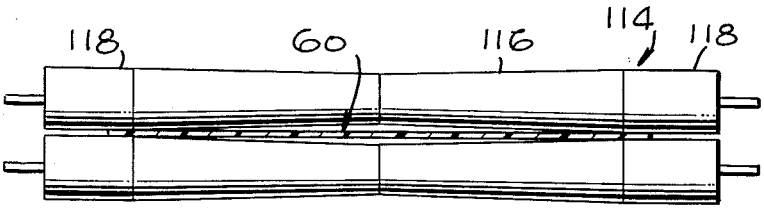
FIG. 10 is a plan view of a roller assembly constructed in accordance with another embodiment of the invention.

Most of the rolls which come in contact with the emulsion side of the film strip are designed to support the film without damaging the emulsion, particularly at the middle portion of the strip where images such as 62 are positioned. Each roller such as roller **36*a* shown in FIG. 5A includes a pair of short cylindrical support surfaces 102, 104** extending inwardly a short distance *d* from a corresponding sprocket wheel, and with a wide cutaway or concave portion 106 between the support cylinders 102, 104. The cutaway portion 106 has a diameter smaller than that of the support cylinders 102, 104 so that it does not contact the diagnostic film 60 and therefore cannot damage the emulsion thereon. The width C of the cutaway portion 106 is less than the width Y of the diagnostic film, so that the edge portions of the diagnostic film 60 are supported on the cylinders 102, 104. Thus, the film is driven along the film path without slippage, while being closely guided in movement therealong, with minimal damage to the emulsion of the film. The guide rollers 92 (FIG. 8) which are on the emulsion side of the film, also have cutaway portions 108 between cylindrical support portions 110, 112, to provide good support for the film. The guide rollers 94 on the non-emulsion side of the film do not have to be provided with cutaway portions.

Where a processor will always be used with film of a predetermined width, rollers with simple cutaways of the type shown in FIG. 8 can be utilized. However, where a processor may be occasionally utilized to develop film strips of a variety of smaller widths, a roller apparatus of the type illustrated in FIG. 10 may be utilized, wherein at least the roller 114 which contacts the emulsion side of the film has a tapered cutaway portion 116 instead of a cylindrical cutaway portion. The tapered cutaway portion 116 tends to engage the edge portions of those films that are not wide enough to rest on the cylindrical end surfaces 118 of the roller, so that there is minimal contact of the roller with the center portion of the film emulsion.

As a film is pulled through the processor, it is desirable to apply firm pressure along the rearward part of the film strip so that it will be held down at curves of the path. Accordingly, a hold-down roll assembly 120 (FIG. 2) is provided at each of the rollers which must contact film coming out of the tank and direct it down into the next tank. The hold-down roll assembly 120 includes a pair of rollers 122 rotatably mounted on a frame 124, which is, in turn, pivotally mounted on a bracket 126 on the frame 12 of the machine. One of the roll assemblies 120' which is positioned between the first and second tanks 14, 16 is useful in serving as a squeegee that tends to squeeze off developer from the film. Its opposed major roll **36*c*** is not cut-away, in order to provide a squeegee action.

After the film has passed through the four chemical-holding tanks and the dryer 22, so that its emulsion has become hardened, it passes into a termination assembly 130 which includes a lamp 132 and transluscent plate 134 that permit viewing of the developed film as it emerges from the dryer. The leading end of the film, with the clip and transport bar thereon, then passes onto a brush roll 136 which disengages the film clip from the transport bar 32 so that the film clip and the leading end of the film attached thereto can fall along the path portion 138 onto the wind-up roll 30.

FIGS. 6, 6A and 7 illustrate details of the termination assembly 130 where the film clip is detached from the transport bar. The termination apparatus includes a pair of sprocket wheels 94*d*, 96*d* which are normally driven by the motor 38 of the processor to advance the belts 84, 86 along the film path. When the transport bar 32, with the film clip and leading end of the film strip, reaches the brush roll 136, the sprocket wheels 94*d*, 96*d* are automatically disengaged from the motor so that the belts and transport bar remain stationary with the leading end of the film partially wrapped about the brush roll 136. However, even though the belts and transport bar are stationary, the brush roll 136 turns. As the brush roll turns, it tends to advance the film clip and film. When the film clip 64 advances a small distance without the transport bar 32, as shown in FIG. 6A, the transport bar 32 is withdrawn through the rearward opening 76 of the film clip and therefore the film clip and transport bar become disengaged. The front portion of the film strip 60 is then free to fall down onto the wind-up roll 30. The film clip 64 is constructed of ferromagnetic material, while the windup roll 30 is constructed with magnets, so that when the clip 64 falls onto the roll 30, it tends to remain engaged with the roll. The roll 30 then turns and winds up the film strip thereon. A thin cardboard tube 144 is normally placed around the roll 30, so that after the film is wound thereon the cardboard tube can be removed together with the film. Thus, the transport bar and film clip permit automatic positive engagement with the film at the beginning of processing, and automatic disengagement at the end of processing, to facilitate the processing of the film strip. It may be noted that the brush roll 136 is in an exposed area, and therefore if disengagement should not occur, a technician can easily disengage the transport bar and film clip by hand.

As shown in FIG. 7, a first gear 131 has a pin 133 that is in the path of the transport bar. When the transport bar engages the pin 133, the gear 131 turns, to turn a gear 135 which is fixed to a cam 137. The cam then moves an arm 139*a* on a bracket 139 which is pivotally mounted about an axis 141. This causes a constantly rotating gear 143 on the bracket to disengage from a gear 145 which is fixed to the same shaft as the pair of ratchet wheels 94*d*, 96*d* that drive the belts 84, 86. Thus, the belts and the transport bar stop moving. The brush roll 136 is driven from a separate drive chain 147 which rotates the brush roll whenever the machine is on. Some of the major rolls 36 are also driven whenever the machine is on, while the other rolls 36 are free wheeling, so that the entire film strip can be pulled out of the machine.

Figure 9A:
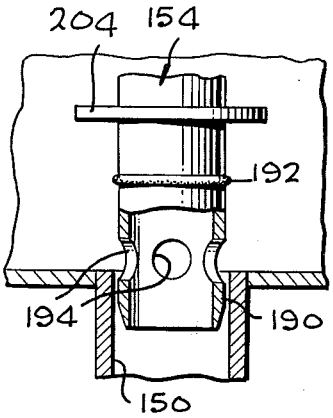
FIG. 9A is a partial sectional view of the replenishing system of FIG. 9, showing the plug in a raised position.
Figure 9:
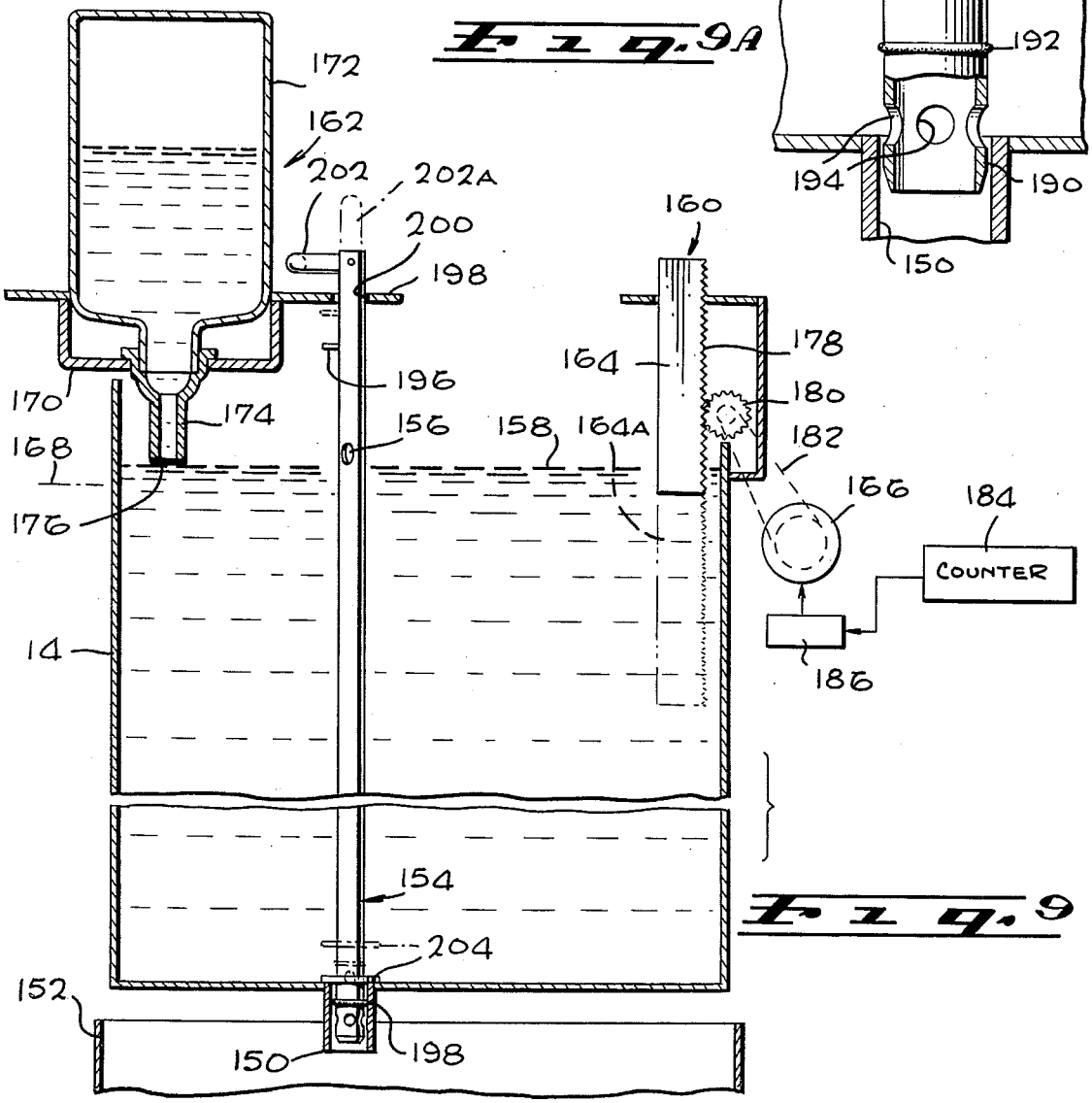
FIG. 9 is a partial sectional and elevation view taken on the line 9—9 of FIG. 1, showing the replenishing system of the invention.

As a film moves through the tanks of chemicals, the chemicals tend to become depleted, or in another word, their potency decreases. FIGS. 9 and 9A illustrate the replenishing system which replenishes the chemicals in tank 14 each time a predetermined length of film has passed through the tank. The replenishing system includes a tubular drain outlet 150 at the bottom of the tank from which chemicals can be drained into a basin 152 for later disposal, and a pipe-like plug 154 which normally plugs the outlet. The plug 154 has an overflow hole 156 which can receive fluid 158 in the tank to drain it. The replenishing system also includes a device 160 for moving a controlled amount of the fluid 158 from the tank into the drain, and apparatus 162 for flowing fresh chemical into the tank to replace the amount moved into the drain so that fluid in the tank is restored to its original level. The device 160 for moving fluid from the tank to the drain includes a plunger 164 which can be moved down into the tank to the position 164A by a motor 166 to displace some of the fluid in the tank and therefore raise the level of the fluid. This causes some of the fluid 158 to overflow through the overflow hole 156 in the plug and down into the drain outlet 150. A short time later, the motor moves the plunger 164 upwardly out of the tank and back to its original position. This causes the fluid 158 to move down to a level indicated at 168.

The replenishing apparatus 162 includes a holder 170 which holds a container 172 of replenishing chemical which has an outlet extension 174 thereon. The container holder 170 supports the container so that an open lower end 176 of the container with the extension 174 thereon lies at the desired level of fluid in the tank. When the fluid level drops below the desired level, as to the lower level indicated at 168, fluid in the container 172 can flow out of the container while air bubbles flow into the container. However, when the fluid level reaches a height equal to the bottom 176 of the container-extension combination, air cannot bubble into the container any longer and the fluid is prevented from flowing out of the container. Thus, the fluid level in the tank is restored to its original level solely by the introduction of the replenishing chemicals from the replenishing container 172. The volume of replenishing chemical introduced into the tank is equal to the additional volume of the piston 164 which is introduced into the tank, less the volume required to raise the fluid level a small amount to begin an overflow into the overflow hole 156.

The plunger 164 is guided in up and down movement by guides (not shown), and the plunger has a rack 178 extending along its center which is engaged by a pinion 180 coupled by a drive chain 182 to the motor 166. The motor 166 is energized by a counter 184 after a predetermined number of developing cycles, the counter 184 being coupled to the sensor 40. The counter operates a circuit 186 which first energizes the motor 166 to rotate in one direction to move th plunger 164 down, and which then energizes the motor in an opposite direction to raise the plunger. The counter 184 serves as a means for counting the number of films passing through the tanks, to cause operation of the circuit 186 that causes fluid movement out of the tanks. A similar replenishing apparatus is provided for each of the other three chemical-holding tanks 16, 18, 20, so that the chemicals in all four tanks are replenished at intervals.

The plug 154 is designed to facilitate the complete draining of the tank 14. The plug includes a lower end with a guide portion 190 slidably received in the drain outlet 150 and movable between the downward position shown in FIG. 9 and the upward position shown in FIG. 9A. An O-ring 192 at the lower portion of the plug normally forms a fluid tight seal with the drain outlet 150 to plug it. However, when the plug is pulled up as shown in FIG. 9A, the O-ring 192 is pulled out of the drain opening so that fluid can flow therethrough. In order to permit rapid fluid flow, the plug is provided with several holes 194 through which fluid can pass. Most of the area of the holes 194 lies above the bottom of the tank when the plug is in its upward position. However, even in its upward position, the extreme lower end of the plug still lies within the drain opening 150, so that reinsertion of the plug is easily accomplished. The upper end of the plug includes a pin 196 which will hit an upper wall 198 of the processor frame when the plug is pulled up, to limit upward movement of the plug so that the extreme lower end of the plug does not move out of the drain opening 150. The upper end of the plug extends through a hole 200 in the frame, and a handle 202 is attached to the upper end of the plug to facilitate raising of the plug. A technician can grasp the handle 202 so that it pivots to the vertical, as indicated at 202A, to pull up on the plug and drain the tank. He can then reinsert the plug by merely pushing down on the top of the plug until a flange 204 at the bottom of the plug abuts the bottom of the tank.

The replenishing container 172 which contains a replenishing chemical, should be provided with opaque walls to prevent the entrance of light into the processor. However, opaque walls would prevent an operator from readily determining when to replace the replenishing container by noting the level of fluid. To enable such an indication, the container 172 is provided with a light transmitting strip 206 (FIG. 1) through which fluid in the tank can be observed. The strip 206 is formed by merely masking the strip area when coating the tank with an opaque paint. The strip 206 is narrow enough and the light path from the strip to the paint area where film is developed is convoluted enough, so that only an insignificant amount of light will reach the film.

The processing machine 10 contains numerous electrical circuits that assure close control of the processing cycle. One of the problems that often arises in the use of film processors is that the chemicals develop fumes that can result in chemical deposits and corrosion. The electrical circuits are particularly sensitive to such deposits and corrosion. In order to minimize such damage to the electrical circuits, most of them are contained in a separate compartment illustrated at 210 in FIG. 1. A blower 212 is provided which has an inlet 214 open to the environment and an outlet 216 opening into the electrical compartment 210. The blower is kept on throughout the day, even when the machine is on a stand-by basis, to keep the electrical compartment 210 pressurized. That is, air in the compartment 210 is at a slightly higher pressure than the pressure of the atmosphere. This prevents the entrance of fumes from the adjacent region where the tanks of chemicals are kept, to thereby minimize chemical deposits and corrosion resulting from chemical fumes seeping into the electrical compartment.

A technician can process diagnostic film which is contained in the cartridge 26 by punching a pair of holes in the leading end of the film, attaching the film clip 64 to the film strip, and inserting the leading end of the film strip with the clip thereon into the processor. Then he depresses a start button 218 (FIG. 1) which causes energization of the machine to begin moving the belts and transport bar 32 thereof along the film path. As soon as the transport bar reaches the film clip, it enters the clip and thereafter drags the clip and the film attached thereto along the film path. After a few minutes, the processed film passes by a viewing station in front of a lamp 132, where the film can be viewed. The film is wound onto a cardboard roll on the windup roll 30, and after a short time the machine automatically stops. The wound up film then can be removed for detailed study. The entire processing procedure can be performed in an ordinary lighted room.

Thus, the invention provides a film processor which moves a film strip in a closely controlled and protected manner and which maintains the processing chemicals at a closely controlled potency, utilizing a simple reliable mechanism that requires minimal skill in operation and maintenance. Movement of the film is facilitated by the use of a film clip attached to the film and a transport for reliably moving the film clip, and by the use of rollers that minimize contact with the film strip. Replenishment of the chemicals is accomplished by a replenishing system that utilizes a simple plunger for draining off some of the fluid and a simple "chicken feeder" apparatus for restoring the drained off fluid with replenishing chemicals.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A film processor comprising:

a frame;

at least one processing tank mounted on said frame, for holding a processing chemical;

means for immersing film in said tank;

drain means for receiving fluid from said processing tank;

controllable means for moving a predetermined volume of fluid from said processing tank to said drain means, to lower the level of fluid in said processing tank; and level restoring means including means for holding a replenishing container and means which are responsive to and which operates shortly after said controllable means lowers the level of fluid, for flowing fluid from the replenishing container to the processing tank in an amount that restores the level of fluid in the processing tank to a predetermined level.

2. The film processor described in claim 1 including:

means counting the number of films passing through said processing tank for controlling said controllable means to move a predetermined volume of fluid from said processing tank to said drain means each time a predetermined plurality of films has passed.

3. A film processor comprising:

a frame;

at least one processing tank mounted on said frame, for holding a processing chemical;

means for immersing film in said tank;

drain means for receiving fluid from said processing tank;

controllable means for moving a predetermined volume of fluid from said processing tank to said drain means, to lower the level of fluid in said processing tank, including a plunger and motor means for moving said plunger into said processing tank and then out of it; and level restoring means for flowing fluid from a replenishing container to the processing tank in an amount that restores the level of fluid in the processing tank to a predetermined level, including means for holding a replenishing container with a lower open end at a level approximately even with said predetermined level to which fluid in the processing tank is restored.

4. In a film processor which includes at least one tank for holding a processing chemical fluid, the improvement of a replenishing system comprising:

drain means for carrying away fluid in said tank when the fluid exceeds a predetermined level;

a plunger;

motor means for moving said plunger in directions into and out of said tank, to thereby raise the fluid level so that some of the fluid spills into said drain means and to then lower the fluid level;

replenishment container means which contains said processing chemical fluid, said container means having an open end through which the chemical fluid can be dispensed; and means for holding said container means with said open end thereof opening downwardly and with said open end at a level no higher than said predetermined level, whereby chemical fluid is automatically dispensed to raise the fluid level in the tank when the plunger is moved in a direction out of the tank.

5. A film processor comprising:

a frame;

at least one processing tank mounted on said frame, for holding a processing chemical at a predetermined level;

means for immersing film in said tank;

a plunger;

motor means for moving said plunger into said processing tank to raise the fluid level above said predetermined level, and for then moving said plunger in a direction out of said tank;

a drain positioned to drain fluid out of said tank so long as the fluid level is above said predetermined level; and level restoring means for flowing fluid from a replenishing container to the processing tank in an amount that restores the level of fluid in the processing tank to a predetermined level.

6. A film processor comprising:

a frame;

at least one processing tank mounted on said frame, for holding a processing chemical;

means for immersing film in said tank;

drain means for receiving fluid from said processing tank;

controllable means for moving a predetermined volume of fluid from said processing tank to said drain means, to lower the level of fluid in said processing tank;

level restoring means including means for holding a replenishing container and means for flowing fluid from the replenishing container to the processing tank in an amount that restores the level of fluid in the processing tank to a predetermined level;

said frame forming a substantially light-tight seal around said tank except at said means for holding a container; and including a replenishing container formed to fit into said means for holding a container, said container having walls which are opaque to prevent the passage of light, except along a narrow substantially vertical strip which can transmit light to enable an operator to see the level of fluid in the container.

7. A film processor system for processing a film strip comprising:

a film clip designed to be fastened to the front end of a film strip, said clip having a rearwardly-facing opening;

a processor frame;

a plurality of tanks disposed on said frame;

transport means releasably attached to said film clip, including a member formed to fit into said rearwardly-facing opening of said film clip to engage and pull said clip;

moving means for moving said transport means in a predetermined film path which extends into and out of said tanks, to drag the film strip through said tanks; and termination means located near an end of said film path for disengaging said film clip means from said transport means, including means for advancing said film clip and film attached thereto to move them faster than said member of said transport means, so that said member passes rearwardly out through the rearwardly-facing opening in the film clip.

8. The system described in claim 7 wherein:

said means for advancing said film clip includes a stop for preventing the advancement of said transport means, a high friction brush roll bearing against said film clip, and means for rotating said brush roll so it turns to move said film clip.

9. A film processor system for processing a film strip comprising:

film clip means designed to be fastened to the front end of a film strip, said film clip means having a rearwardly-facing opening;

a processor frame;

a plurality of tanks disposed on said frame;

transport means releasably attachable to said film clip means, including a member formed to fit into said rearwardly-facing opening of said film clip means to engage and pull it;

moving means for moving said transport means in a predetermined film path which extends into and out of said tanks, to drag the film strip through said tanks; and termination means located near an end of said film path, including first means responsive to the front end of said film with said clip means and transport means thereon, for stopping said moving means so that the film and clip means stop advancing along said film path, second means for advancing said film clip means so it moves out of engagement with said transport means, a wind-up roll, third means for holding said film clip means on said wind-up roll, and means for turning said wind-up roll to wind said film thereon.

* * * * *